US005462597A

United States Patent [19]

Jubran

[11] Patent Number: 5,462,597

[45] Date of Patent: Oct. 31, 1995

[54] SYSTEM FOR INKLESS FINGERPRINTING

[75] Inventor: Nusrallah Jubran, St. Paul, Minn.

[73] Assignee: Minnesota Mining and Manufacturing, Saint Paul, Minn.

[21] Appl. No.: 268,625

[22] Filed: Jun. 30, 1994

[51] Int. Cl.[6] ..... B41K 1/36

[52] U.S. Cl. ..... 118/31.5; 427/1; 427/150; 503/213; 503/221; 503/225

[58] Field of Search ..... 118/31.5; 427/1, 427/150; 428/914; 503/213, 221, 225

[56] References Cited

U.S. PATENT DOCUMENTS

| | | | |
|---|---|---|---|
| 2,082,735 | 6/1937 | Heinecke | 41/41 |
| 3,831,552 | 8/1974 | Schmidt et al. | 118/31.5 |
| 3,960,632 | 6/1976 | Gaines et al. | 156/245 |
| 4,232,083 | 11/1980 | Buerkley et al. | 428/307 |
| 4,262,623 | 4/1981 | Smith, III et al. | 118/31.5 |
| 4,379,178 | 4/1983 | Meadows et al. | 427/1 |
| 4,699,077 | 10/1987 | Meadows et al. | 118/31.5 |
| 4,859,650 | 8/1989 | Hilterhaus et al. | 503/213 |
| 4,879,134 | 11/1989 | Vassiliades | 427/1 |
| 4,880,766 | 11/1989 | Miller et al. | 503/212 |
| 5,009,919 | 4/1991 | Vassiliades | 427/1 |
| 5,017,546 | 5/1991 | Brinkman et al. | 503/211 |
| 5,030,281 | 7/1991 | Miller et al. | 106/21 |
| 5,143,551 | 9/1992 | Mason, Jr. et al. | 118/31.5 |
| 5,214,021 | 5/1993 | Takahashi et al. | 503/213 |
| 5,233,404 | 8/1993 | Lougheed et al. | 356/71 |
| 5,263,742 | 11/1993 | Koch | 283/78 |
| 5,330,959 | 7/1994 | Raby et al. | 503/201 |

FOREIGN PATENT DOCUMENTS

| | | | |
|---|---|---|---|
| 0593192A2 | 4/1994 | European Pat. Off. | B41M 5/165 |

*Primary Examiner*—Timothy M. McMahon

*Attorney, Agent, or Firm*—Gary L. Griswold; Walter N. Kirn; Gregory A. Evearitt

[57] ABSTRACT

A fingerprinting system comprising means capable of releasably retaining a liquid and a liquid composition releasably retained in said means, said liquid composition comprising a leuco color-former coupound, a dialkyl phthalate wherein the alkyl group contains 1–3 carbon atoms, a substrate for receiving fingerprints associated therewith, said substrate being coated on at least a portion of one surface thereof with a color developing substance comprising a phenol/aldehyde condensation product produced by the reaction together of an alkyl-substituted salicylic acid, an alkyl-substituted phenol, and an aldehyde, said condensation product having been reacted with a metal source.

16 Claims, No Drawings

SYSTEM FOR INKLESS FINGERPRINTING

BACKGROUND OF THE INVENTION

1. Field of the Invention

The present invention relates to inkless fingerprinting systems used for identification purposes and to unique solvents, color-formers, and developer combinations for such systems.

2. Background of the Art

The fingerprint patterns or ridge endings and ridge separations are highly individualized and are not altered with time. The unique character of the fingerprint of an individual has provided the basis for police identification of criminals, establishing the identity of accident victims, newly born babies, and numerous other situations and the comparison of fingerprint patterns has long been accepted as an absolute means of identifying individuals in a multitude of criminal and non-criminal situations.

Traditionally fingerprints have been made with printing or writing types of ink, usually comprising finely ground carbon black particles dispersed in a liquid vehicle. The most common method used to make fingerprints is to impregnate a pad with ink, transfer the ink to the surface of the object to be fingerprinted or identified, and subsequently transfer the ink to the surface of the substrate where the final print is to be made. Such a procedure is cumbersome, time consuming, and results in severe soiling of the hands and clothing of everyone involved in the fingerprinting process. This method also suffers from other drawbacks. If the fingers are wet with perspiration the image tends to blur and to lose resolution. This technique also requires great care and expertise to obtain good print.

In order for a fingerprint identification system to be commercially acceptable it must be extremely stable and reliable. The prints must be distinct and clear and must be easily readable by the human eye and by automated fingerprint reading systems which are finding increased use especially within law enforcement agencies. Furthermore the prints must form very rapidly and must possess a high degree of stability toward temperature, humidity, and light. The systems must be simple and aesthetically inoffensive. Inking methods suffer from the need to clean the finger of residual ink to prevent staining of objects handled after the fingerprint has been taken. This creates a disposal problem of the wipes used to clean the ink from the fingers. The cleaning operation is particularly objectionable when fingerprinting or footprinting babies.

Although improved techniques for fingerprinting which do not stain the finger have been developed they have not been widely adopted.

Draeger et al., U.S. Pat. No. 5,143,551 discloses a single use inking card for fingerprinting, with overlapping interconnected front and back sheets with an inked sheet in between.

Koch, U.S. Pat. No. 5,263,742 discloses an inkless fingerprinting system comprising a transparent sheet coated with a pressure sensitive adhesive film and an element for back-reflecting radiant energy for making a copy of the fingerprint.

Lougheed et al., U.S. Pat. No. 5,233,404 also discloses an inkless method of recording a fingerprint. A finger is placed on an illuminated surface and the image is projected onto a viewing surface. The image is then recorded with a charge coupled device which is rolled synchronously with the finger on the illuminated surface.

In yet another system for recording fingerprints, U.S. Pat. No. 4,699,077 teaches a pad impregnated with a color-former composition sealed in a packet and associated with a substrate carrying developer composition. The pad contains a polyhydroxy aromatic developer and the receptor contains the color-former. Exposure of sensitive skin to the these polyhydroxy aromatics is subject to question because of the nature of these compounds.

A fingerprint system based upon the formation of a colored image by the reaction of a transition metal salt with a dithiooxamide ligand is commercially available from 3M Company, St. Paul, Minn. under the name of "The Identifier." However, the color of the image produced is not black.

Additional inkless fingerprinting systems have been proposed. U.S. Pat. No. 3,831,552 discloses the use of magnetizable powders. U.S. Pat. No. 2,082,735 discloses the use of chelation of metal salts with organic acids. U.S. Pat. Nos. 3,960,632, 4,262,623, and 4,379,178 disclose the reaction of 8-hydroxyquinoline with metal salts such as ferric chloride. U.S. Pat. No. 4,232,083 discloses the use of metal complexing compounds having a plurality of ligand groups with transition metal salts of oleophilic organic acids to form dark images which can be useful in fingerprinting systems.

Vassiliades, U.S. Pat. No. 5,009,919 discloses a system for inkless fingerprinting using a color-former in an oleophilic solvent and a substrate coated on one surface with color developer. Vasiliades lists requirements for the solvent, specifically mentioning solvating properties for the color-former, low evaporation rate, good flow properties, and no adverse-toxicological effects. He then lists solvents such as alkylated phenyls, such as monoisobutyl biphenyl and monoisopropyl biphenyl; chlorinated paraffins; alkylated naphthalenes; partially hydrogenated terphenyls, such as Monsanto HB-40; natural vegetable oils such as soya-bean oil, cottonseed oil, and coconut oil; ester alcohols such as Eastman Kodak's Texanol™; alkylated glycol ethers and ether acetates such as Eastman Kodak's Ektasolve™ series; and combinations thereof. Numerous developers for the color-former are described including common carbonless paper developers such as acid clays, phenolics, and salicylic acid; as well as color-formers obtained by augmenting the developer with additional metal developers. A variation on this method is also taught by Vassiliades in U.S. Pat. No. 4,879,134 wherein a fingerprint pad contains reacted color-former and developer. Here again, solvents, color-formers, and developers are those described in U.S. Pat. No. 5,009,919 above.

While these patents recognize the need for fast development of a fingerprint system that does not stain fingers, they use only the usual carbonless paper solvents. These solvents all suffer from specific deficiencies, such as objectionable odor, limited solubility of the leuco dye color-former (as in the case of the vegetable oils), toxicity (as in the case of the chlorinated paraffins), or irritation of the skin (as in the instances involving aromatic and hydrogenated aromatics).

One aspect of the importance of the solvent to image-forming properties, such as high solubility of the color-former, is the need for maintaining compatibility with sensitive skin. This issue was addressed in Hilterhaus et al., U.S. Pat. 4,859,650. Hilterhaus et al. were concerned with the preparation of a carbonless paper using leuco dye color-formers in capsules. The inventors used triphenylmethane leuco dyes with improved solubility. This allowed them to use a solvent composed of at least 80% of plant, animal, or paraffin oils. Their improved leuco dyes were soluble to the extent of 7 to 10 parts by weight in their preferred solvents compared with a solubility of only 1 part by weight of a typical commercially available color-former in their preferred solvents. The inventors were motivated because: "The mentioned solvents for carbonless paper are occasionally viewed with distrust, causing skin irritations upon use of the carbon paper [sic]manufactured therewith." (column 1, lines 24–27) and "Accordingly, there is a need to be able to substitute these solvents by such solvents which are less hazardous in this connection." (column 1, lines 31–33).

Of critical importance to the fingerprinting system is the solvent. The solvent for the color-former must satisfy many requirements. It must be nontoxic and not have an unpleasant odor. It must be colorless or nearly colorless. It must be able to dissolve the color-former and provide a medium in which rapid reaction between color-former and developer can occur. It must be stable and not react with either the color-former or developer. It should be absorbed into the substrate without causing blotting or "feathering." Solvents that have traditionally been used for fingerprinting include diarylalkanes, such as phenylxylylethane and phenylethylphenylethane; aromatic hydrocarbons such as alkylnaphthalenes; biphenyls and substituted biphenyls.

A major problem with present inkless fingerprinting systems is the slow rate of development of the image (i.e., slow speed). This is because inkless fingerprinting systems have traditionally been based on carbonless paper chemistry, and employed color-formers, solvents, and developers designed for carbonless papers. However, unlike carbonless paper systems where initial development is important but ultimate image density develops only after several hours; a fingerprinting system requires rapid development of a good, dark fingerprint within seconds. This is to allow examination of the fingerprint and re-fingerprinting if necessary. Quite often with previous inkless fingerprinting systems, the color of the fingerprint did not appear to develop so the finger was again placed on the developer. Later examination indicated overlapping fingerprints. This, of course, is unacceptable. Similarly, the use of encapsulation solvents for carbonless paper is not favored as carbonless paper solvents do not necessarily satisfy the requirements for a good fingerprinting solvent. Some irritate the skin. Some are expensive, some do not dissolve enough color-former to provide an intense color, and some are too volatile. A particular shortcoming of encapsulation solvents for carbonless paper is that they are "too slow." That is, when used in fingerprinting the image forms very slowly. The need for an improved inkless fingerprinting system remains.

SUMMARY OF THE INVENTION

The present invention describes a fingerprinting system comprising means capable of releasably retaining a liquid and a liquid composition releasably retained in said means, said liquid composition comprising a leuco color-former compound, a dialkyl phthalate wherein the alkyl group contains 1–3 carbon atoms, a substrate for receiving fingerprints associated therewith, the substrate being coated on at least a portion of one surface thereof with a color developing substance comprising a phenol/aldehyde condensation product produced by the reaction together of an alkyl-substituted salicylic acid, an alkyl-substituted phenol, and an aldehyde, the condensation product having been reacted with a metal source.

In another embodiment the liquid composition may further comprise a dialkyl phthalate wherein the alkyl group contains 1–3 carbon atoms. In another embodiment the liquid composition may further comprise a mixture of a dialkyl phthalate wherein the alkyl group contains 1–3 carbon atoms and an alkyl benzoate wherein the alkyl group contains 10–18 carbon atoms.

The fingerprint system of the present invention can be prepared by combining specific solvents satisfying the above requirements with specific color-formers and developers. The present invention provides a fingerprint system which can solve the problems of conventional inkless fingerprinting systems and which is inexpensive, provides excellent development speed, and forms sharp images with dark, permanent color.

In one embodiment, the color-former is a fluoran leuco dye susbstituted in the 2-position with anilino groups. In a preferred embodiment, the leuco dye color-former is a mixture of 2-anilino-3-methyl-6-diethylaminofluoran and 2-anilino-3-methyl-6-dibutylaminofluoran. Preferrably, the leuco dye color-former is present in the fingerprinting system in an amount of from 8–14 weight percent, based upon the total weight of said fingerprinting system.

In a preferred embodiment, the alkyl phthalate is diethyl phthalate and the alkyl group of the alkyl benzoate contains 12–15 carbon atoms. In one embodiment the weight ratio of dialkyl phthalate/alkyl benzoate is in the range of from 3:1 to 1:3.

The formation of the image is rapid and the resolution of the image is sharp and clear. The image is also stable for long periods of time. The solvents used to dissolve the color-former are not only compatible with the skin, but they are able to dissolve high concentrations of color-former enabling the formation of a dark image in very short times. The invention overcomes the problems associated the previous art and permits the use of an innocuous non staining finger print ink useful in commercial trade.

The invention further comprises a method of generating an image of the fingerprint by transfer of leuco dye color-former dissolved in an innocuous solvent combination.

As used herein, the term "fingerprint," also encompasses "footprint" such as those taken of newly born babies and placed on birth records, and "noseprint" such as those taken of animals.

As used herein, the term "inkless" means the absence of colored pigments such as carbon black and as being distinct from printing inks.

As is well understood in this technical area, a large degree of substitution is not only tolerated, but is often advisable. As a means of simplifying the discussion and recitation of certain terminology used throughout this application, the terms "group" and "moiety" are used to differentiate between chemical species that allow for substitution or which may be substituted and those which do not so allow or may not be so substituted. Thus, when the term "group" is used to describe a chemical substituent, the described chemical material includes the unsubstituted group and that group with conventional substitution. Where the term "moiety" is used to describe a chemical compound or substituent, only an unsubstituted chemical material is intended to be included. For example, the phrase "alkyl group" is intended to include not only pure open-chain and cyclic saturated hydrocarbon alkyl substituents, such as methyl, ethyl, propyl, t-butyl, cyclohexyl, adamantyl, octadecyl, and the like, but also alkyl substituents bearing further substituents known in the art, such as hydroxyl, alkoxy, vinyl, phenyl, halogen atoms (F, Cl, Br, and I), cyano, nitro, amino, carboxyl, etc. On the other hand, the phrase "alkyl moiety"

is limited to the inclusion of only pure open-chain and cyclic saturated hydrocarbon alkyl substituents, such as methyl, ethyl, propyl, t-butyl, cyclohexyl, adamantyl, octadecyl, and the like.

Other aspects, advantages, and benefits of the present invention are apparent from the detailed description, examples, and claims.

DETAILED DESCRIPTION OF THE INVENTION

This invention describes an improved system for fingerprinting. The essential components of a fingerprinting system are the leuco dye color-former compounds, the solvent for the color-former compounds, and the developer. In order for a fingerprinting system to function properly, all components must work well together. For example, a high concentration of color-former is important because formation of a dark image is required. Also, the solvent must wet the finger evenly, distributing the solvent/color-former mixture on the finger. The solvent must also wet the paper evenly so as not to form a blurred or smeared fingerprint.

The color-former compounds are leuco dye color-formers which posses the unique property of being colorless in neutral or alkaline media, but become colored when they react with an acidic or electron accepting substance.

The color-former selected in the subject invention must be able to provide a black image and must also possess the property of being soluble in the solvents of choice at high levels. Preferrably, the leuco dye color-former is present in the fingerprinting system in an amount of from 8–14 weight percent, based upon the total weight of the solvent plus color-formers in said fingerprinting system.

In one embodiment, the color-former is a fluoran leuco dye color-former susbstituted in the 2-position with an anilino group. In a preferred embodiment, the leuco dye color-former is a mixture of 2-anilino-3-methyl-6-diethylaminofluoran and 2-anilino-3-methyl-6-dibutylaminofluoran. These color-formers are available from the Ciba Geigy Company under the tradenames of Black I-R and Black I-2R.

The solvents for the fingerprinting system must also posses unique properties. As noted above, the solvent for the color-former must satisfy many requirements. It must be nontoxic, odorless, colorless, nonreactive, and non wicking. It must also be able to dissolve the color-former and provide a medium in which rapid reaction between color-former and developer can occur.

In one embodiment, the solvent is a dialkyl phthalate wherein the alkyl group contains 1–3 carbon atoms. In another embodiment the solvent is a mixture of a dialkyl phthalate wherein the alkyl group contains 1–3 carbon atoms and an alkyl benzoate wherein the alkyl group contains 10–18 carbon atoms. In a further embodiment, the solvent is a mixture of a dialkyl phthalate wherein the alkyl group contains 1–3 carbon atoms and an alkyl ester of a fatty acid wherein the alkyl group contains 1–5 carbon atoms and the fatty acid group contains 10 to 18 carbon atoms. In a preferred embodiment, the dialkyl phthalate is diethyl phthalate and the alkyl group of the alkyl benzoate contains 12–15 carbon atoms. Preferrably, the weight ratio of dialkyl phthalate to alkyl benzoate is in the range of from 3:1 to 1:3. In another preferred embodiment, the dialkyl phthalate is diethyl phthalate and the alkyl ester is isopropyl palmitate or isopropyl myristate. Preferrably, the weight ratio of dialkyl phthalate to alkyl ester is in the range of from 3:1 to 1:3.

The preferred solvents meet the above noted requirements. They have a high solubility for common leuco dye color-formers, give rapid development of dark images when used with a commercially available developer composed of a metal salt of a salicylic acid terminated oligomer of phenol with formaldehyde. They are also non irritating to the skin. A preferred co-solvent, Finsolve™ is readily available and is used in the cosmetic industry.

In the present invention it was found the usual carbonless paper developers did not provide the rapid development speeds needed for this immediate development of the fingerprint.

The developers used in the present invention are produced by the interaction of an alkyl-substituted salicylic acid, an alkyl-substituted phenol, an aldehyde, and a metal source to form a phenol/aldehyde condensation product.

The alkyl-substituted salicylic acid is preferably substituted with at least one alkyl group containing three or more carbon atoms. Preferably, the alkyl group contains at least four carbon atoms, especially four to twelve carbon atoms. Particularly useful are salicylic acids of the formula:

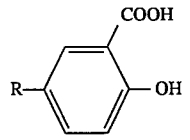

where R is an alkyl group containing form four to twelve carbon atoms. Preferably, the group R is octyl or nonyl, especially tertiary-octyl (derived from diisobutene) and nonyl (derived from propylene trimer). The group R may also be a dodecyl group. The most preferred materials use a nonyl group.

The alkylphenol component preferably contains at least one alkyl group containing at least three carbon atoms, especially four to twelve carbon atoms. In particular, the phenols are phenols substituted in the para-position with an alkyl group, R', containing four to twelve carbon atoms, particularly tertiary-butyl, tertiary-octyl, nonyl (derived from propylene trimer), and dodecyl. The preferred materials use a tertiary-octyl group.

The aldehyde is preferably formaldehyde, although the formaldehyde may be supplied, for example, from paraformaldehyde, or a similar source of formaldehyde.

The preferred metal source is zinc oxide.

The exact composition of the product is not known, but it is believed to have the general formula:

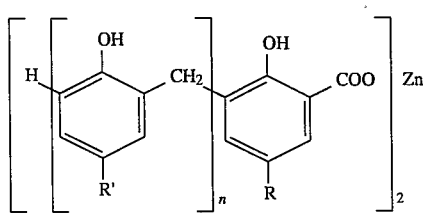

The phenol/aldehyde condensation product may be synthesized by combining and heating the alkyl-substituted salicylic acid, the alkyl-substituted phenol, the aldehyde, the metal source, and water.

A developer of this type, based upon a zinc salt of a salicylic acid terminated oligomer of phenol/formaldehyde is sold by the Schenectady Chemical Company under the name of HRJ 10802. Developers of this type are further described in U.S. Pat. No. 5,017,546 the disclosure of which is incorporated herein by reference.

The developer may be coated on the developer sheet by a variety of means such as wire wound rod, reverse roll coating, curtain coating, knife coating, etc. Good results can be obtained using a coating mixture containing approximately 20% developer to give a coating weight of about 1.8 pounds per ream (1300 square feet).

As mentioned above, when compared with carbonless paper, speed of image formation is of paramount importance in inkless fingerprinting. The present fingerprinting system provides a black image on a light background. Upon use, the fingerprint is immediately visible just a few seconds after the imprint is made.

The density of the image is a function of the solubility of the color former in the solvent. In general a solubility of less than 4–6% (wt %) will not give an image dark enough to be useful in a fingerprint system. Unfortunately, most color-formers are not soluble in solvents typically employed in carbonless paper at greater than this amount, or if soluble they slowly crystallize or precipitate from solution. We have found that a mixture of color-formers in favored solvents of the invention, do not interact and each color-former maintains its individual solubility. By using two black color-formers, each of which is soluble in a developer a very high concentration of color-former in the solvents of this invention can be obtained.

For example, diethyl phthalate, (DEP) a co-solvent commonly used carbonless tends to give a very slow image when used alone. Therefore, mixtures of DEP with other solvents are often used to encapsulate color-formers for carbonless papers. In contrast, diethyl phthalate works very well in the present fingerprinting system.

Objects and advantages of this invention will now be illustrated by the following examples, but the particular materials and amounts thereof recited in these examples, as well as other conditions and details, should not be construed to unduly limit this invention.

EXAMPLES

All materials used in the following examples were readily available from standard commercial sources, such as Aldrich Chemical Co. (Milwaukee, Wis.), unless otherwise specified. All percentages are by weight unless otherwise indicated. The following additional terms and materials may be used.

Colloid 230 is a surfactant sold by Colloids, Inc., Newark N.J.

Clay #2 is sold by Thiele Kaolin Company, Sandersville Ga.

Calcined clay is available from J. M. Huber Co., Macon Ga.

Ciba Geigy Black I-R is 2-anilino-3-methyl-6-diethylamino fluoran and is available from Ciba Geigy, Greensboro, N.C. [CAS 29512-49-0].

Ciba Geigy Black I-2R is 2-anilino-3-methyl-6-dibutylamino fluoran and is available from Ciba Geigy, Greensboro, N.C. [CAS 89331-94-2].

DEP is diethyl phthalate CAS [84-66-2]

Dow 620 latex is available from Dow Chemical Co., Midland Mich.

EXX is Exxon AE 700 a mixture of $C_7$–$C_9$ branched alkyl phthalate esters available from Exxon Corp.

Finsolve™ TN is a mixture of $C_{12}$–$C_{15}$ alkyl benzoates sold by Finetex Corp., Elmwood Park, N.J. [CAS 684 11-27-8]. It has an acute oral toxicity of 34.5 g/kg and a primary dermal irritation index (rabbits) of 0.08.

Foam Kill is a silicone defoamer manufactured by Crucible Chemical Co., Greenville S.C.

HRJ 4023 is a zinc salt of a phenolic developer sold by Schenectedy Chemical Co., Schenectedy, N.Y.

HRJ 10802 is a zinc salt of a phenolic/salicylate developer sold by

Schenectedy Chemical Co., Schenectedy N.Y.

IPP is isopropyl palmitate $CH_3(CH_2)_{14}COO—CH(CH_3)_2$

IPM is isopropylmyristate $CH_3(CH_2)_{12}COO—CH(CH_3)_2$

PVA 603 is a polyvinyl alcohol sold by Air Products Company, Allentown Pa.

Starch #716 is available from Clinton Corp., Clinton Iowa.

Examples 1–2

Preparation of Color-Former Sheet:

A color-former solution was prepared by dissolving 6 parts by weight of Ciba Geigy Black I-R (2-anilino-3-methyl-6-diethylamino fluoran) and 6 parts by weight of Ciba Geigy Black I-2R (2-anilino-3-methyl-6-dibutylamino fluoran) in 88 parts by weight solvent. The solvent was a mixture of 33 parts by weight of Finsolve™ TN and 67 parts by weight of diethyl phthalate. Finsolve™ TN is a mixture of $C_{12-C15}$ alkyl benzoates. It has an acute oral toxicity of 34.5 g/kg and a primary dermal irritation index (rabbits) of 0.08. Diethyl phthalate has an acute oral toxicity of 1.0 g/kg (rabbit). A 4 inch by 7 inch (10.16 cm×17.78 cm) piece of crepe paper was saturated with 0.50 mL of a solution of color-former. The paper was then sealed in a packet of impermeable paper coated with a heat sealable polymer. The color-former/solvent was allowed to equilibrate in the sealed packet overnight.

Example 1

A developer solution was prepared from the components shown below. A developer sheet was prepared by coating the developer solution on 20 pound basis weight paper was coated on a reverse roll coater. The dry coating weight was 1.4 lb/ream.

| Component | Amount | Weight (Dry) |
|---|---|---|
| Water | 32.88 | 0.0 |
| Surfactant | 0.63 | 0.274 |
| Clays | 36.25 | 36.25 |
| Starch (32%) | 9.38 | 3.00 |
| HRJ 10802 | 17.5 | 8.75 |
| Styrene/Butadiene latex | 4.0 | 2.0 |

The index finger of a person was pressed lightly on the pad of crepe paper saturated with the color-former solution described above. The finger was then pressed against the paper prepared with the coating containing the developer. A black image of the fingerprint of the finger appeared immediately. The finger was wiped clean with a tissue with no discomfort to the skin.

Example 2

A second solution of developer was made up and applied to 20 pound basis weight paper by silk screen printing on a small area of the paper. This developer solution contained the following components:

A silk screen master was prepared with a silk screen with #305 mesh. The developer solution was silk screen printed onto a small area of 20 pound basis weight paper. The dry coating weight was 2.0–2.2 lb/ream.

| Component | Amount | Weight (Dry) |
|---|---|---|
| Water | 26.0 | 0.0 |
| Surfactant | 0.60 | 0.261 |
| Clays | 38.25 | 38.25 |
| Poly(vinyl alcohol) (40.0%) | 8.25 | 3.3 |
| HRJ 10802 (50.0%) | 19.25 | 9.625 |
| Styrene/Butadiene latex (50%) | 4.4 | 2.2 |
| Silicone Defoamer (56.0%) | 3.3 | 0.185 |

The index finger of a person was pressed lightly on the sheet of crepe paper saturated with the color-former solution described above. The finger was then pressed against the paper in the area silk screen coated with developer. A black image of the fingerprint of the finger appeared immediately. The finger was wiped clean with a tissue with no discomfort to the skin.

Examples 3

Examples 3 describes the evaluation and comparison of additional solvents. Color-former and solvent were placed in a vial and the mixture heated to effect solution. The vial was closed and kept at room temperature for 3 days. If solid precipitated from the solution, the solvent was considered not acceptable. The solubilities of two leuco dye color-formers in various solvents is as follows.

| Color-Former | Solvent | Solubility (wt %) |
|---|---|---|
| Ciba Geigy I-R | Finsolve ™ TN | ca. 3–4% |
| Ciba Geigy I-R | IPP | ca. 3–4% |
| Ciba Geigy I-R | IPM | ca. 3–4% |
| Ciba Geigy I-2R | DEP | ca. 6% |
| Ciba Geigy I-2R | Finsolve ™ TN | ca. 3–4% |
| Ciba Geigy I-2R | IPP | ca. 3–4% |
| Ciba Geigy I-2R | IPM | ca. 8% |

Example 4

Color-former solutions were prepared by dissolving various amounts of Ciba Geigy Black I-R (2-anilino-3-methyl-6-diethylamino fluoran) and/or various amounts of of Ciba Geigy Black I-2R (2-anilino-3-methyl-6-dibutylamino fluoran) in various solvents or solvent mixtures. The solvents evaluated are shown in the table below. A 4 inch by 7 inch (10.16 cm×17.78 cm) piece of crepe paper was saturated with 0.50 mL of a solution of color-former. The paper was then heat sealed in a laminated aluminum foil packet. The color-former/solvent was allowed to equilibrate in the sealed packet overnight.

The packet was opened and the crepe paper was pressed several times on the index finger. The finger was then lightly placed on the a sheet of CF carbonless paper and the image was evaluated. Two sheets of CF carbonless papers were used to develop the image. The first sheeet was a developer sheet of 3M CF Schotchmark™ Carbonless Paper and was obtained from Carbonless Products Department, 3M Co, St. Paul, Minn. 3M CF Schotchmark™ Carbonless Paper is a very reactive developer for carbonless paper. It is believed to contain a zinc salt of a phenolic resin such as HRJ 4023. The second sheet was a developer sheet prepared as in Example 1 above and contained HRJ 10802, a zinc salt of a phenolic/salicylate developer.

The image was gaded as follows:

Good if a useable clear fingerprint resulted within 15 seconds.

Poor if a fingerprint developed in longer than 15 seconds, if the fingerprint was smudged, or illegible (i.e., if the fingerprint spread, bloomed, or wicked into the paper).

The table below, compares the speed of development of two developer systems using solutions containing the same color-formers. The Scotchmark™ system employs a developer on a zincated phenolic resin. The developer of the invention employs a zincated phenolic benzoate polymer. As shown in the following table, the ability to form an image rapidly is a function of the solvent or solvents, as well as the developer. When a zinc salt of a phenolic resin was used as a developer poor results were obtained. When a zinc salt of a phenolic/salicylate resin was used as a developer good results were obtained only when certain solvents were used.

| Color-Former Concentration | | Solvent | Fingerprint on Scotchmark ™ CF | Fingerprint on CF of Example 1 |
|---|---|---|---|---|
| 3–4% | Ciba Geigy Black I-R | FIN | poor | poor |
| 3–4% | Ciba Geigy Black I-R | IPP | poor | poor |
| 3–4% | Ciba Geigy Black I-R | IPM | poor | poor |
| 8% | Ciba Geigy Black I-R | DEP | poor | good |
| 12% | Ciba Geigy Black I-R | DEP | poor | good |
| 12%* | Ciba Geigy Black I-R | DEP/FIN (2:1) | poor | good |
| 12%* | Ciba Geigy Black I-R | DEP/IPP (2:1) | poor | good |
| 12%* | Ciba Geigy Black I-R | DEP/IPM (3:1) | poor | good |
| 12%* | Ciba Geigy Black I-R | EXX/FIN (1:1) | poor | poor |
| 15% | Ciba Geigy Black I-R | EXX | poor | poor |
| 3–4% | Ciba Geigy Black I-2R | FIN | poor | poor |
| 3–4% | Ciba Geigy Black I-2R | IPP | poor | poor |
| 8% | Ciba Geigy Black I-2R | IPM | poor | poor |
| 12%* | Ciba Geigy Black I-2R | DEP/FIN (2:1) | poor | borderline |
| 12%* | Ciba Geigy Black I-2R | EXX/IPP (1:1) | poor | borderline |
| 15% | Ciba Geigy Black I-2R | EXX | poor | poor |
| 6% | Ciba Geigy Black I-R + | DEP | poor | good |
| 6% | Ciba Geigy Black I-2R | | | |
| 6% | Ciba Geigy Black I-R + | DEP/FIN (1:1) | poor | good |

-continued

| Color-Former Concentration | | Solvent | Fingerprint on Scotchmark ™ CF | Fingerprint on CF of Example 1 |
|---|---|---|---|---|
| 6% | Ciba Geigy Black I-2R | | | |
| 6% | Ciba Geigy Black I-R + | DEP/IPP (1:1) | poor | good |
| 6% | Ciba Geigy Black I-2R | | | |
| 6%* | Ciba Geigy Black I-R + | EXX/FIN (2:1) | poor | borderline |
| 6% | Ciba Geigy Black I-2R | | | |
| 6%* | Ciba Geigy Black I-R + | EXX/IPP (2:1) | poor | borderline |
| 6% | Ciba Geigy Black I-2R | | | |
| 6%* | Ciba Geigy Black I-R + | EXX/IPM (2:1) | poor | borderline |
| 6% | Ciba Geigy Black I-2R | | | |

*Compound precipitated out of solution when stored for more than 3 days.

Reasonable modifications and variations are possible from the foregoing disclosure without departing from either the spirit or scope of the present invention as defined by the claims.

What we claim is:

1. A fingerprinting system comprising means capable of releasably retaining a liquid and a liquid composition releasably retained in said means, said liquid composition consisting essentially of: (i) a leuco color-former compound and a solvent selected from the group consisting of: a dialkyl phthalate wherein the alkyl group contains 1–3 carbon atoms; said dialkyl phthalate and an alkyl benzoate wherein the alkyl group of said alkyl benzoate contains 10 to 18 carbon atoms; and said dialkyl phthalate and an alkyl ester of a fatty acid wherein the fatty acid group contains 10 to 18 carbon atoms; and (ii) a substrate for receiving fingerprints associated therewith, said substrate being coated on at least a portion of one surface thereof with a color developing substance consisting essentially of: a phenol/aldehyde condensation product produced by the reaction of an alkyl-substituted salicylic acid, an alkyl-substituted phenol, and an aldehyde, said condensation product having been reacted with a metal source.

2. The fingerprinting system according to claim 1 wherein the weight ratio of said dialkyl phthalate/alkyl benzoate is in the range of from 3:1 to 1:3.

3. The fingerprinting system according to claim 1 wherein said dialkyl phthalate is diethyl phthalate.

4. The fingerprinting system according to claim 1 wherein the alkyl group of said alkyl benzoate has from 12 to 15 carbon atoms.

5. The fingerprinting system according to claim 1 wherein the weight ratio of said dialkyl phthalate/alkyl ester is in the range of from 3:1 to 1:3.

6. The fingerprinting system according to claim 1 wherein said leuco color-former compound is present in said fingerprinting system in an amount of from 8–14 weight percent, based upon the total weight of said fingerprinting system.

7. The fingerprinting system according to claim 1 wherein said leuco color-former compound is a fluoran leuco dye substituted in the 2-position with anilino groups.

8. The fingerprinting system according to claim 1 wherein said alkyl-substituted salicylic acid is substituted with at least one alkyl group containing at least three carbon atoms.

9. The fingerprinting system according to claim 8 wherein said alkyl-substituted salicylic acid is of the formula:

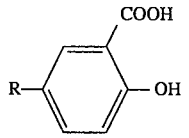

wherein R is an alkyl group containing from 4 to 12 carbon atoms.

10. The fingerprinting system of claim 9 wherein R is an alkyl group.

11. The fingerprinting system of claim 10 wherein R is a tertiary alkyl group.

12. The fingerprinting system of claim 10 wherein R is a nonyl group.

13. The fingerprinting system of claim 10 wherein R is a dodecyl group.

14. The fingerprinting system of claim 1 wherein said alkyl-substituted phenol is substituted with at least one alkyl group containing at least three carbon atoms.

15. The fingerprinting system of claim 14 wherein said alkyl-substituted phenol is substituted in the para-position with an alkyl group containing from 4 to 12 carbon atoms.

16. The fingerprinting system of claim 1 wherein said metal source is zinc oxide.

* * * * *